US007213532B1

(12) United States Patent
Simpson

(10) Patent No.: US 7,213,532 B1
(45) Date of Patent: May 8, 2007

(54) SYSTEM AND METHOD FOR MANAGING THE BUOYANCY OF AN UNDERWATER VEHICLE

(76) Inventor: Steven M. Simpson, 114 Cuyama Rd., Ojai, CA (US) 93023

( * ) Notice: Subject to any disclaimer, the term of this patent is extended or adjusted under 35 U.S.C. 154(b) by 51 days.

(21) Appl. No.: 11/195,250

(22) Filed: Aug. 1, 2005

(51) Int. Cl.
*B63G 8/14* (2006.01)
*B63G 8/22* (2006.01)

(52) U.S. Cl. ..... 114/331; 114/333

(58) Field of Classification Search ..... None
See application file for complete search history.

(56) References Cited

U.S. PATENT DOCUMENTS 5,235,931 A * 8/1993 Nadolink ..... 114/321
6,148,759 A * 11/2000 Taylor, Jr. ..... 114/312

* cited by examiner

*Primary Examiner*—Jesus Sotelo
*Assistant Examiner*—Daniel V. Venne
(74) *Attorney, Agent, or Firm*—Ralph D. Chabot

(57) ABSTRACT

The present invention provides a system and a method, including a gas supply proximate to a worksite, for repetitively recharging the ballast tank of an underwater vehicle as required to control its buoyancy while moving underwater payloads.

13 Claims, 9 Drawing Sheets

600

| TASK | | OPERATION | | Activity |
|---|---|---|---|---|
| 604 ROV Deployment | 610 | First ROV Deployment Alternative | | |
| | 612 | Second ROV Deployment Alternative | | |
| 606 ROV Work | 614 | Workstation | 626 | Payload Transfer |
| | | | 628 | Gas Transfer |
| | | | 630 | Buoyancy Adjustment |
| | 616 | Transport | 632 | Move With Payload |
| | 618 | Destination | 626 | Payload Transfer |
| | | | 630 | Buoyancy Adjustment |
| | 620 | Return | 638 | Move Without Payload |
| 608 ROV Recovery | 622 | First Recovery Alternative | | |
| | 624 | Second Recovery Alternative | | |

FIG. 6

SYSTEM AND METHOD FOR MANAGING THE BUOYANCY OF AN UNDERWATER VEHICLE

BACKGROUND OF THE INVENTION

1. Field of the Invention

The present invention relates to the mechanical arts and methods that embody underwater work methods. More particularly, it relates to devices and methods for improving the productivity of a remotely operated vehicle (ROV) engaged in underwater maintenance and construction work.

2. Description of Related Art

Conventional underwater work techniques often include the use of remotely operated vehicles (ROV's). A surface support vessel and its associated personnel support and operate the ROV. The ROV may be deployed directly from the support vessel or from the surface via a tether management system (cage). When deployed directly from the surface, the ROV is connected to its control and powering components on the support vessel with an umbilical cable. When deployed from the surface in a cage, the cage and ROV are lowered to a location near the worksite on a similar umbilical cable. Thereafter, the ROV may be maneuvered from the cage to the worksite while coupled to a tether extending between the ROV and the cage.

Regardless of the method employed to deploy the ROV to the worksite, ROV's are designed so that they are essentially neutrally buoyant (they neither float nor sink). Therefore, addition or removal of payloads (weight) to/from the ROV requires that the ROV have either excess thrust capacity or the ability to add or remove buoyancy or ballast to compensate for the addition or removal of weight.

ROV operations include use at an underwater worksite to manipulate various payloads. Supporting payloads with a specific gravity (SG) greater than unity tends to make the ROV sink. Supporting payloads with a SG less than unity tends to make the ROV float. Because of this, the ROV must be able to compensate for or manage its buoyancy when on-loading or off-loading a payload.

A typical ROV utilizes fixed buoyant volumes such as syntactic foam or fixed air voids in combination with its vertical thruster's capacity to manage its buoyancy relative to the ROV equipment's weight or negative buoyancy. When large packages are added to the ROV, the package's buoyancy is typically compensated for via fixed buoyant volumes or ballast tanks added to the package at the surface, thereby enabling the ROV to manage the package's buoyancy. The ballast tank may be filled with gas or liquid or a combination of both. Replacing liquid with gas in the ballast tank makes the ROV rise while replacing gas with liquid tends to make the ROV sink. Typically, the gas is air and the liquid is water.

When on-loading a dense payload (SG>1) the ROV's buoyancy may be adjusted by replacing liquid with gas (deballasting) in the ballast tank. To compensate for off-loading the dense payload, the ROV's buoyancy may be adjusted by replacing gas with liquid (ballasting) in the ballast tank. Conversely, to compensate for on-loading a scant payload (SG<1), the ROV's buoyancy may be adjusted by replacing gas with liquid. The ROV's buoyancy may be adjusted to compensate for offloading the scant payload by replacing liquid with gas.

The ROV consumes compressed gas from an integral (onboard) gas storage system each time it performs the deballasting operation. When the integral gas storage supply is depleted, it must be replenished. The ROV must return to the surface for gas replenishment. A remote operator maneuvers the vehicle back to the surface, either directly or via the cage, where surface vessel resources replenish its integral gas storage system. Redeployment of the ROV is in either case accomplished by reversing the recovery operations.

ROV productivity is significantly reduced when it is employed to repetitively move payloads from one location to another. Repeated on-loading and off-loading of payloads requires repeated gas recharge operations which deplete the ROV's integral gas storage supply. The ROV is therefore required to make frequent trips to the surface to replenish this supply. Such trips to the surface consume time and are inefficient, regardless of how the ROV is deployed.

Accordingly, there has existed a need for improved ROV buoyancy control systems. There is a still further need for improved ROY work methods. The present invention satisfies these and other needs, and provides further related advantages.

SUMMARY OF THE INVENTION

According to the invention, a system and method is provided for managing the buoyancy of a ROV working at an underwater site. The ROV includes an integral ballast tank, a fluid connector in fluid communication with said ballast tank, and optionally an integral pressurized gas storage tank in fluid communication with the fluid connector. A second mating fluid connector is located proximate to the underwater site. One or more pressurized gas storage tanks are in fluid communication with said second connector. The gas storage tanks are separate from said ROV. Interconnection of the first and second mating fluid connectors provides for gas transfer to the ROV. The gas transfer may refill said integral gas storage tank, recharge the ballast tank, or both.

The ROV is adapted to engage and disengage payloads. Neutral buoyancy of the ROV is restored in conjunction with following a payload on-load or off-load by adjusting the ROV ballast. Gas consumed by the ROV during these buoyancy adjustments is supplied/replenished by the gas transfer operations.

An underwater workstation may be located proximate to the underwater site. The payload(s), second fluid connector, and one or more of the gas storage tanks may be mounted on the workstation. While adjacent to the payload at a first location, the ROV may exchange a payload, perform gas transfer, and adjust buoyancy as needed. Subsequently the ROV may transport the payload to a second location where payload exchange and buoyancy adjustment activities may be repeated.

BRIEF DESCRIPTION OF THE DRAWINGS

The present invention is described with reference to the accompanying figures. In the figures, like reference numbers indicate identical or functionally similar elements. The accompanying figures, which are incorporated herein and form a part of this description, illustrate the present invention and, together with the description, further serve to explain the principles of the invention and enable a person skilled in the relevant art to make and use the invention.

FIG. 6 is a tabular description of a ROV project.

DESCRIPTION OF THE PREFERRED EMBODIMENTS

Introduction

The present invention provides time saving work methods and systems applicable to the operation of a ROV. ROV systems operated according to the present invention have specific features and advantages, including, but not limited to, increased productivity and reduced operating risk. These features and advantages are especially evident when the ROV is repetitively moving payloads from one location to another.

As noted above, a ROV may advantageously employ the present invention to support or to carry out underwater work, including maintenance, repair, and construction work. The system and methods described enable a ROV to replenish its gas supply proximate to the worksite. These and other features and advantages of the present invention will now be described in detail with reference to the accompanying drawings.

Improved ROV Work Methods

Figure 1:
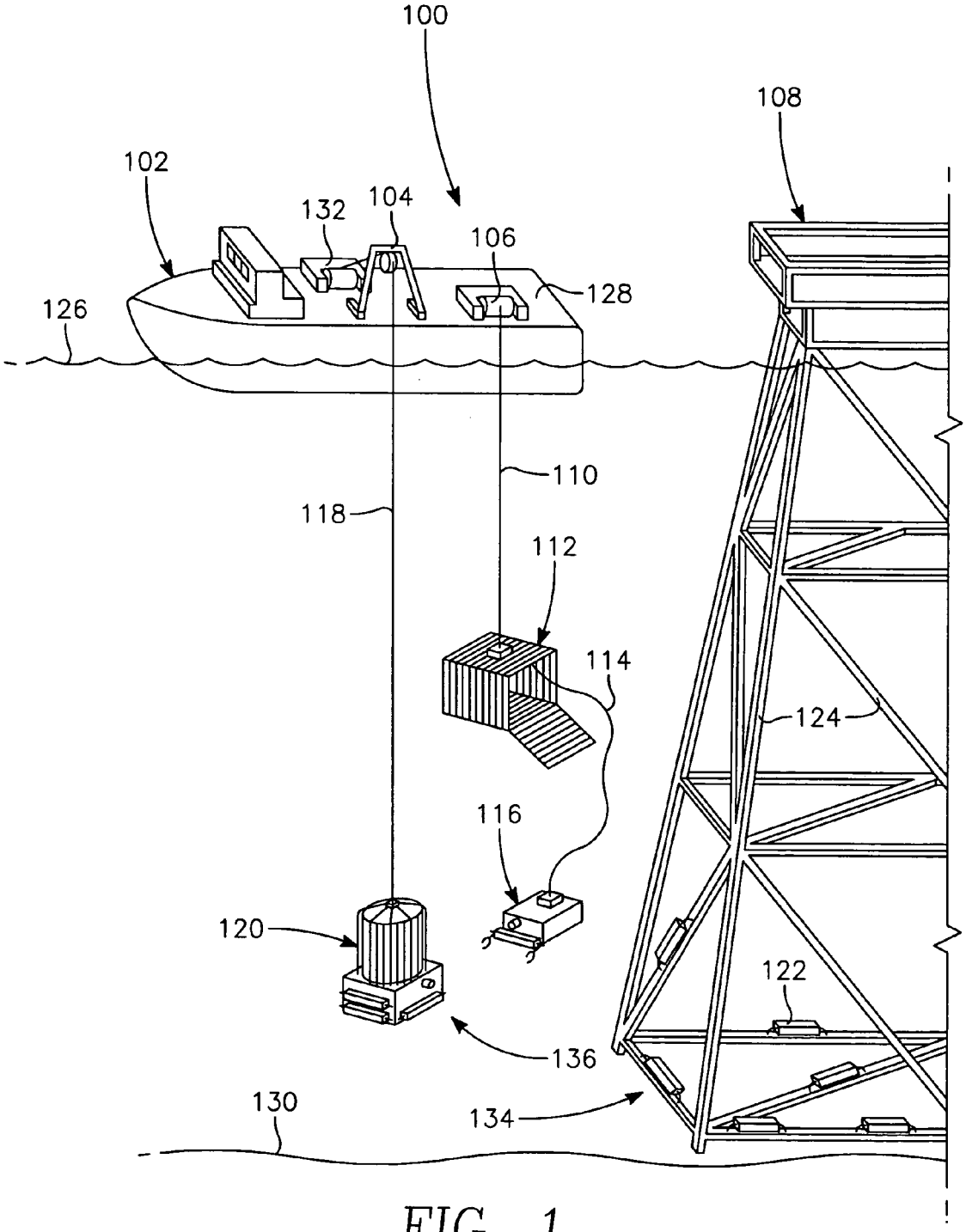
FIG. 1 is an isometric view of a ROV spread complete with a cage deployed at a typical worksite.

In an embodiment, FIG. 1 shows a ROV spread 100 with a deployed ROV 116 mobilized at an underwater worksite 130. The worksite typically comprises a ROV 116, an underwater workstation 120, a stationary structure 108, and a payload destination area 134. The workstation is lowered to the worksite by the station winch 132 and boom 104 on support vessel 102 using a station umbilical means 118. The ROV is coupled by a ROV tether 114 to a cage 112 that includes a tether management system. The cage is suspended above the worksite using an umbilical means shown as cage umbilical 110. The cage umbilical is deployed from a cage winch 106 located on the support vessel.

The support vessel 102 provides a deck 128 where the aforementioned winches, booms, tethers, and umbilical means are mounted. The support vessel also provides dry storage locations on the deck for the ROV 116, cage 112, and workstation 120.

The words "umbilical means," as used herein, refers to one or more lines and/or conductors that may be grouped into one or more bundles. The umbilical means is generally flexible and may be spooled on a winch or otherwise coiled. The umbilical means may include load bearing line(s) (a metallic cable is typical), electrical cables(s), fiber optic cable(s), and fluid transport line(s). The word "tether" as used herein, refers to an umbilical means extending from the ROV to the cage for the potential supply of load bearing, electrical, fiber optic, and fluid transport connectivity.

With continued reference to FIG. 1, the underwater worksite includes an offshore structure 108. Submerged metallic portions 124 of offshore structures are frequently protected from corrosion by cathodic protection systems such as anodes 122. One object of the present invention is to provide an improved ROV work-method for servicing anodes.

Figure 2:
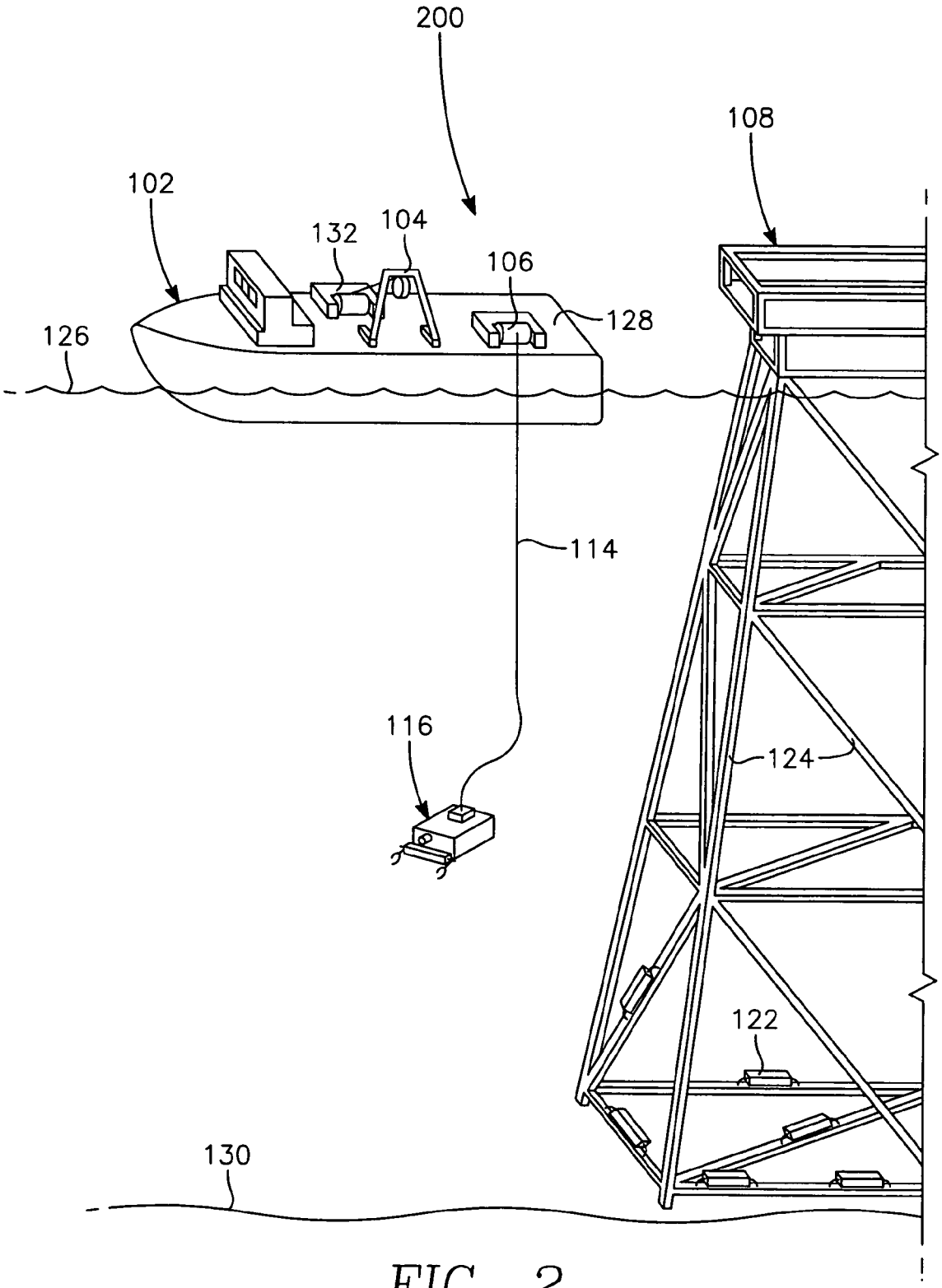
FIG. 2 is an isometric view of a ROV spread excluding a cage deployed at a typical worksite.

Referring now to FIG. 2, a second embodiment of the present invention is illustrated that excludes the cage 112. In this embodiment, a cageless ROV spread 200 with a deployed ROV 116 is shown. The ROV is coupled by an umbilical 114 to the support vessel 102. The umbilical is deployed from a winch 106. With the cageless ROV spread, the ROV is deployed directly from the support vessel 102 rather than from an underwater cage. The cageless ROV spread may be used for worksites in relatively shallow water (generally less than 150 feet in depth).

Figure 3:
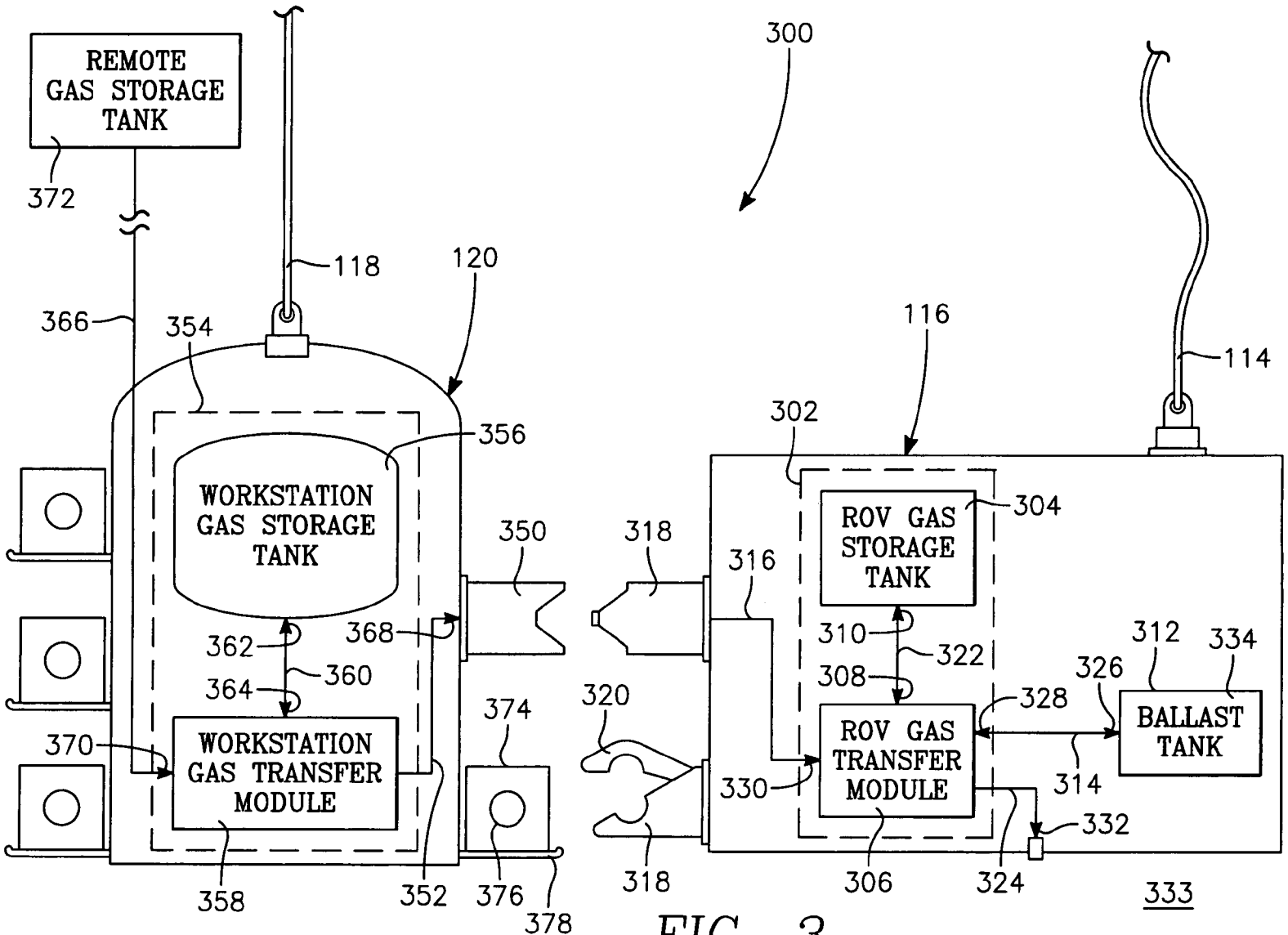
FIG. 3 is a schematic view of the gas supply and refill components located on the ROV and workstation.

Referring now to FIG. 3 and the features of the present invention adapted to gas supply and replenishment, a gas refill system 300 is shown. Selected gas refill system equipment is integrated with the ROV 116 and with the workstation 120. Gas transfer between the ROV and the workstation is enabled when a ROV connector 318 and a workstation connector 350 are mated. In an embodiment, the ROV and the workstation each have one or more connectors 318 and 350 respectively (one of each is shown). At least one ROV connector 318 and one mating workstation connector 350 are capable of exchanging fluids. Any of these connectors may also be capable of exchanging one or more of electrical signals, optical signals, and mechanical loads with mating connectors.

Still referring to FIG. 3, the ROV equipment comprising a part of the gas refill system includes a ROV gas supply system 302 and a ROV connector 318. The gas supply system includes a ROV gas transfer module 306 and a ROV gas storage tank 304 (optional). The gas transfer module may include valve(s) and control(s) for managing gas flow and may be partially or wholly integrated with the connector. An optional ROV gas transfer line 322 fluidly connects the gas transfer module and the gas storage tank. Gas flow in this transfer line is bi-directional as shown by the flow arrows to 308 and from 310 the gas transfer module.

Still referring to FIG. 3, the ROV gas inlet line 316 fluidly connects the gas transfer module and the connector. Gas flow in the inlet line is toward the gas transfer module as shown by a flow arrow 330. A gas recharge line 314 fluidly connects the gas transfer module 306 and the ballast tank 312. Gas flow in this recharge line is bi-directional as shown by the flow arrows to 328 and from 326 the gas transfer module. Finally, a vent line 324 fluidly connects the gas transfer module and the underwater environment 333. Flow in the vent line is toward the underwater environment as indicated by a flow arrow 332.

In an embodiment of FIG. 3, the ROV equipment comprising a part of the gas refill system 300 excludes the optional ROV gas storage tank 304 and the ROV gas transfer line 322. This embodiment relies on gas storage means separate from the ROV 116 to supply gas to the ballast tank 312 for gas recharge.

In another embodiment of FIG. 3, the ROV equipment comprising a part of the gas refill system 300 includes the optional ROV gas storage tank 304 and the ROV gas transfer line 322. This embodiment may rely on gas storage means integral to and/or separate from the ROV 116 for gas recharge.

With continued reference to FIG. 3, workstation equipment comprising a part of the gas refill system 300 includes a station gas supply system 354 and a station connector(s) 350 designed to mate with the ROV connector(s) 318. The gas supply system includes a station gas transfer module 358 and an optional station gas storage tank 356. The gas transfer module includes valve(s) and control(s) for managing the gas flow and may be partially or wholly integrated with the connector. A station gas transfer line 360 fluidly connects the gas transfer module and the optional gas storage tank. Gas flow in this transfer line is bi-directional as shown by the flow arrows to 364 and from 362 the gas transfer module.

Still referring to FIG. 3, an optional station gas supply line 366 fluidly connects the station gas transfer module 358 and an optional auxiliary gas storage tank 372 that is separate from the ROV 116. Gas flow in this supply line is toward the gas transfer module as shown by a flow arrow 370. A station discharge line 352 fluidly connects the station gas transfer module and the station connector 350. Gas flow in the discharge line is toward the station connector as shown by a flow arrow 368. Either one of or both of the optional gas storage tanks 356 (including transfer line 360) and 372 (including supply line 366) are included in the workstation equipment comprising a part of the gas refill system 300.

In still another embodiment of FIG. 3, the workstation equipment comprising a part of the gas refill system 300 includes the optional auxiliary gas storage tank 372 and the station gas supply line 366; it excludes the optional station gas storage tank 356 and the station gas transfer line 360. This embodiment provides a gas storage means that may be either integral or external to the workstation 120.

In another embodiment of FIG. 3, the workstation equipment comprising a part of the gas refill system 300 includes the optional station gas storage tank 356 and the station gas transfer line 360; it excludes the auxiliary station gas storage tank 372 and the station gas supply line 366. This embodiment provides a gas storage means that is integral to the workstation 120.

In yet another embodiment of FIG. 3, the workstation equipment comprising a part of the gas refill system 300 includes the optional auxiliary gas storage tank 372, the station gas supply line 366, the station gas storage tank 356, and the station gas transfer line 360. This embodiment provides a gas storage means that is integral to the workstation 120 and that may also be external to the workstation.

Referring again to FIG. 3, workstation features adapted for manipulating payloads 374 are shown. Workstation 120 may provide one or more storage racks 378 for holding one or more payloads 374. The payload(s) 374 is fitted with a handle 376 suitable for engagement with the ROV manipulator 320.

Figure 4:
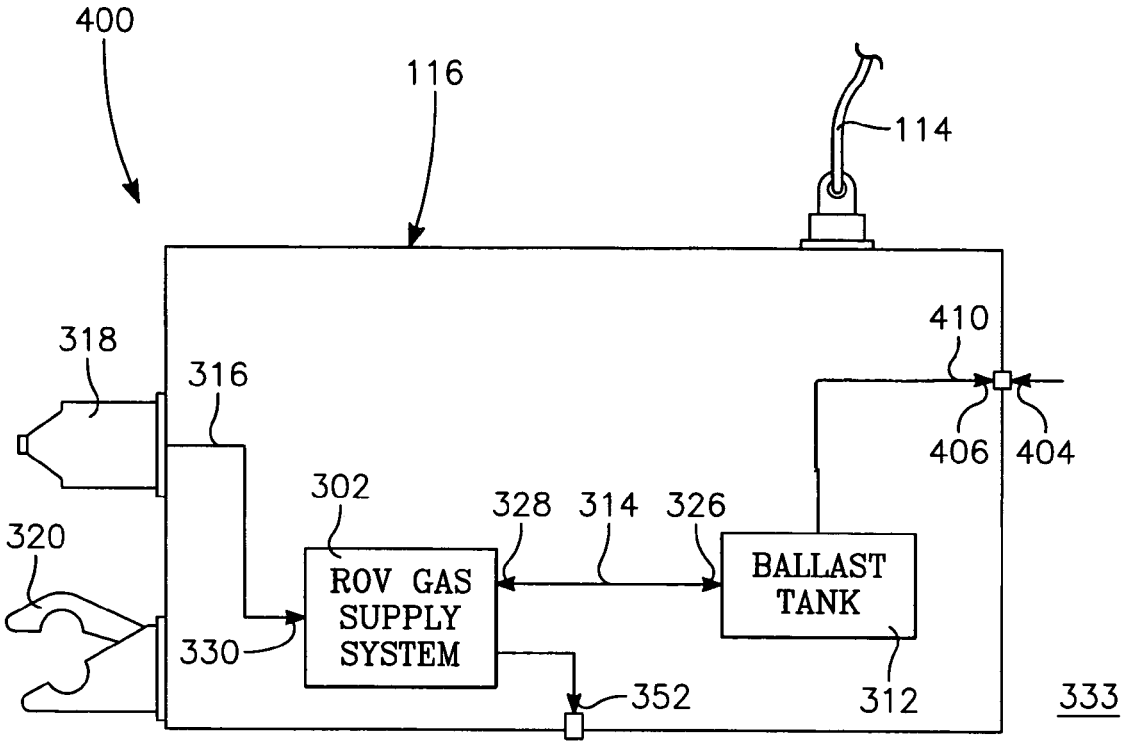
FIG. 4 is a schematic view of the gas supply, refill, and liquid transfer components located on the ROV.

In FIG. 4, a ROV buoyancy management system 400 is shown. Selected buoyancy management equipment is integrated onto the ROV 116. The buoyancy management equipment functions include varying the liquid fraction in the ballast tank 312. Minimum ROV buoyancy is achieved when the tank is full of liquid, the liquid fraction is 100%, and the gas fraction is 0%. Maximum ROV buoyancy is achieved when the tank is full of gas, the liquid fraction is 0%, and the gas fraction is 100%.

Still referring to FIG. 4, the ROV 116 has a ballast tank 312. In an embodiment, the ROV gas supply system 302 is fluidly connected to the ballast tank via a gas recharge line 314. The ballast tank is also in fluid communication with the ROV underwater environment 333 via a liquid transfer line 410. When gas is exchanged for liquid in the ballast tank (increases ROV buoyancy), a gas flow arrow 326 indicates gas flow into the ballast tank while a liquid flow arrow 406 indicates the corresponding liquid flow from the ballast tank. When liquid is exchanged for gas in the ballast tank (decreases ROV buoyancy), liquid flow arrow 404 indicates liquid flow into the tank while gas flow arrow 328 indicates the corresponding gas flow from the tank. Ballast tank 312 may include pumps, valves, and controls that facilitate ballast exchange operations.

Figure 5:
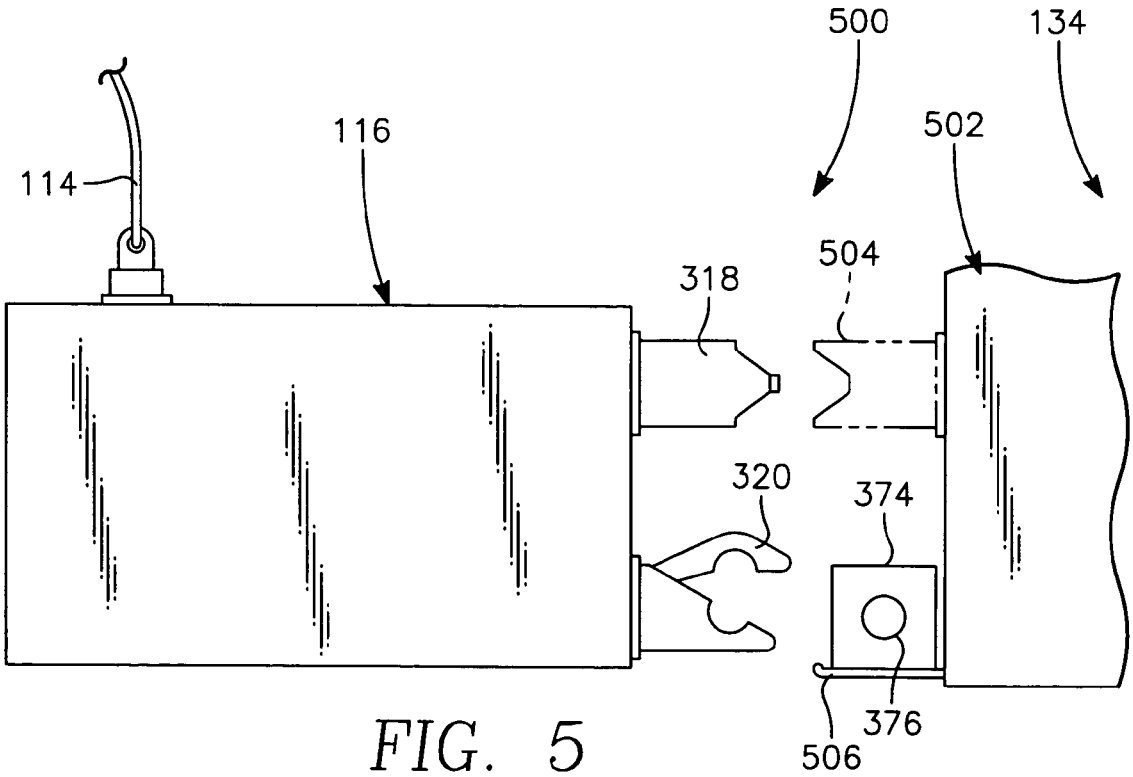
FIG. 5 is a schematic view of a ROV and a worksite.

FIG. 5 is a view 500 of the ROV 116 adjacent to a payload transfer structure 502. In the present example, the payload transfer structure is a portion of an underwater structure and the payload is an anode. The transfer structure provides one or more interfaces 506 for receiving the payload. The transfer structure also provides one or more optional connectors 504 for mating with the ROV connector(s) 318. Connector(s) 504 may exchange electrical signals, optical signals, or mechanical loads with ROV connector(s) 318. Those skilled in the art will recognize that the features and benefits of the present invention are adaptable to many underwater worksites and to payloads associated with those worksites.

Operation

Referring to FIG. 6, a typical underwater project 600 utilizing the present invention is outlined in tabular format. The project employs a ROV 116 to move multiple payloads 374 between a first submerged location 136 and a second submerged location 134. Project tasks include ROV deployment 604, ROV work 606, and ROV recovery 608. These tasks comprise operations that are more fully described below.

FIGS. 1 and 2 illustrate alternative operations for deploying the ROV. In FIG. 1, the first deployment alternative 610 involves the use of a ROV cage 112. The ROV is lowered in the cage from the surface vessel 102 to a location 136 near the worksite 130 and is then maneuvered from the cage to the worksite. In FIG. 2, a second deployment alternative 612 does not involve use of a ROV cage. Here, the ROV is deployed directly from the surface vessel and is maneuvered from the surface 126 to the worksite 130. Once the ROV deployment task is completed, the ROV work task may begin.

Figure 7:
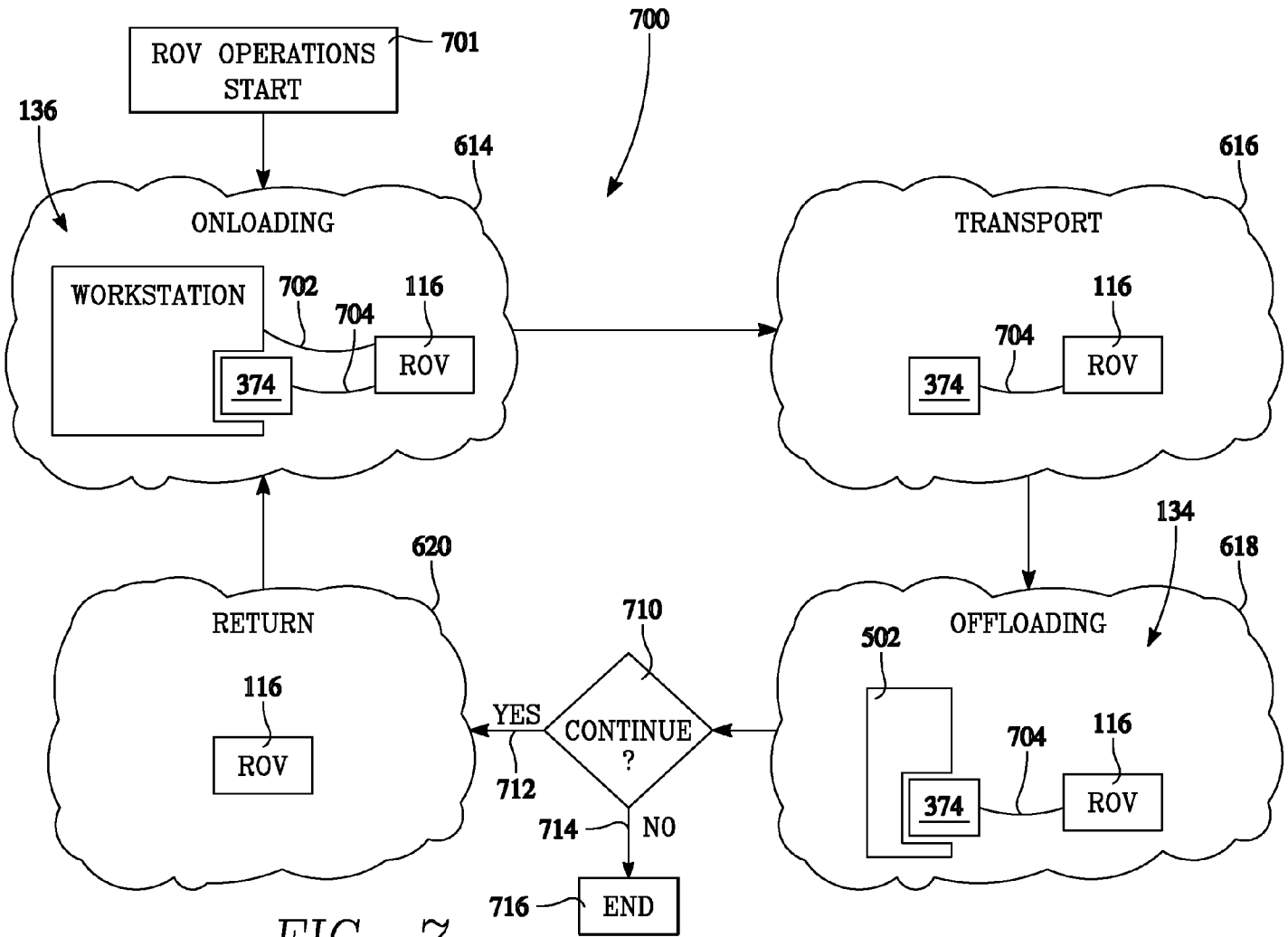
FIG. 7 is a schematic showing operations that comprise the ROV work task.

FIG. 7 illustrates sequential operations comprising an exemplary ROV work task. From the ROV work task start 701, the methodology progresses to the workstation operation 614 which includes payload transfer. A transport operation 616 follows where the payload is moved to a second location 134. The methodology then progresses to a destination operation 618 where the ROV off-loads the payload. A decision step 710 follows. If the ROV work task cycle is to be repeated, a first cycle alternative 712 is chosen; the methodology then proceeds to a return operation 620 where the ROV is maneuvered back to the first payload transfer location 136. If the ROV work task operation is to be discontinued, a second cycle alternative 714 is chosen and the methodology then proceeds to a ROV work task end-step 716. The end-step 716 may be followed by ROV recovery task 608. These operations comprise activities that are further described below.

Referring again to FIG. 6, the workstation operation 614 is further described by tabulated activities. In particular, the figure shows that the workstation operation 614 comprises activities including payload transfer 626, gas transfer 628, and buoyancy adjustment 630. These activities are described below and illustrated in the flowchart form of FIG. 8.

Figure 8:
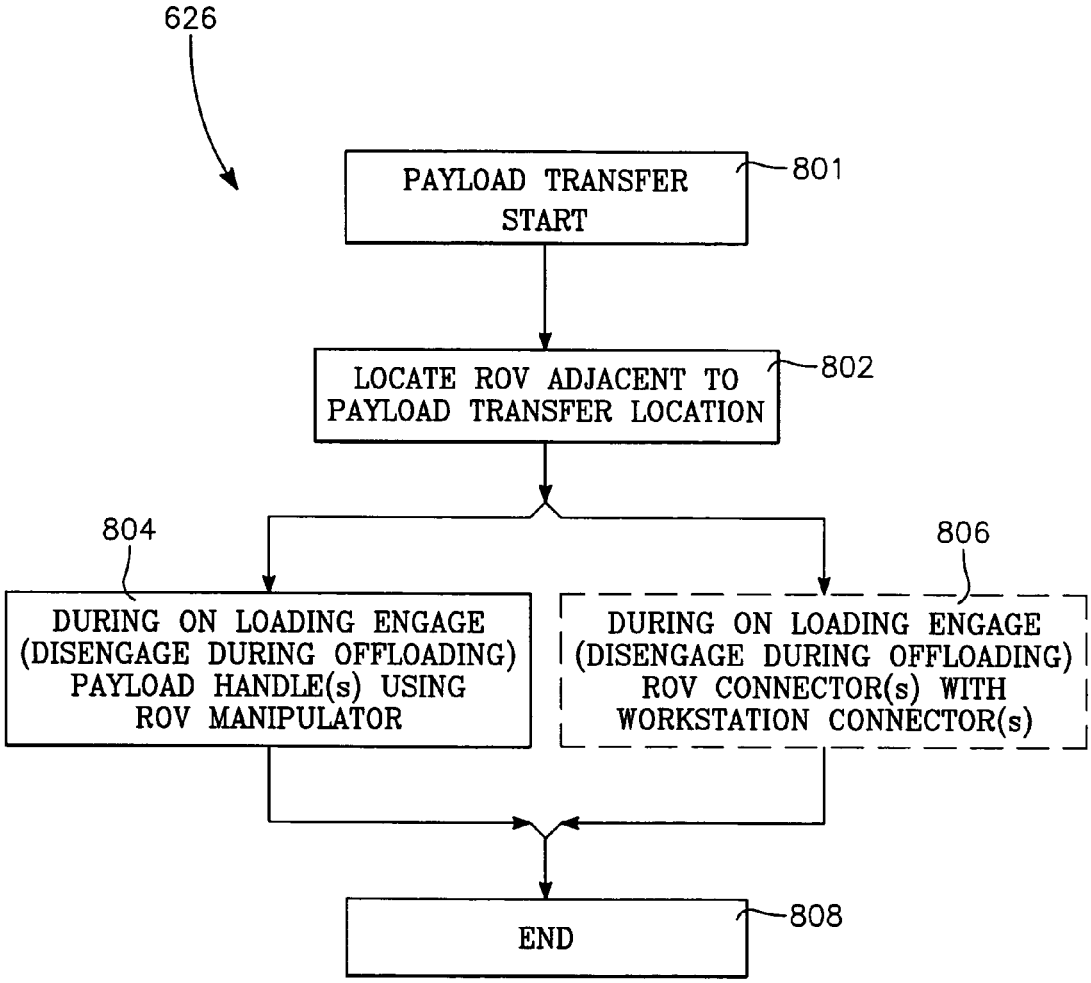
FIG. 8 is a flowchart showing steps that comprise the payload transfer activity.

Referring to FIG. 8, the payload transfer activity 626 is further illustrated by flowcharted steps. The methodology begins at step 801 and progresses to step 802 where the ROV is located adjacent to a payload transfer location 136, 134. Step 804 follows where during on-loading the ROV engages (disengages during off-loading) the payload handle(s) 376 with its manipulator 320 to form manipulator connection(s)

704. The methodology may also include the optional step 806 where the ROV connector(s) 318 is engaged with the workstation connector(s) 350 to form a ROV/workstation connection(s) 702. The manipulator connection provides a mechanical connection between the ROV and the payload for transporting the payload. The ROV/workstation connection(s) may provide any one or more of fluid, electrical, optical, and mechanical connections between the ROV and the workstation. In an embodiment; mechanical connection(s) provided by the ROV/workstation connection(s) stabilize the ROV during payload transfer and or periods of non-neutral buoyancy. End-step 808 follows steps 804 and 806. While adjacent to the workstation, the ROV may receive buoyancy compensation gas from the workstation as described below.

Figure 9:
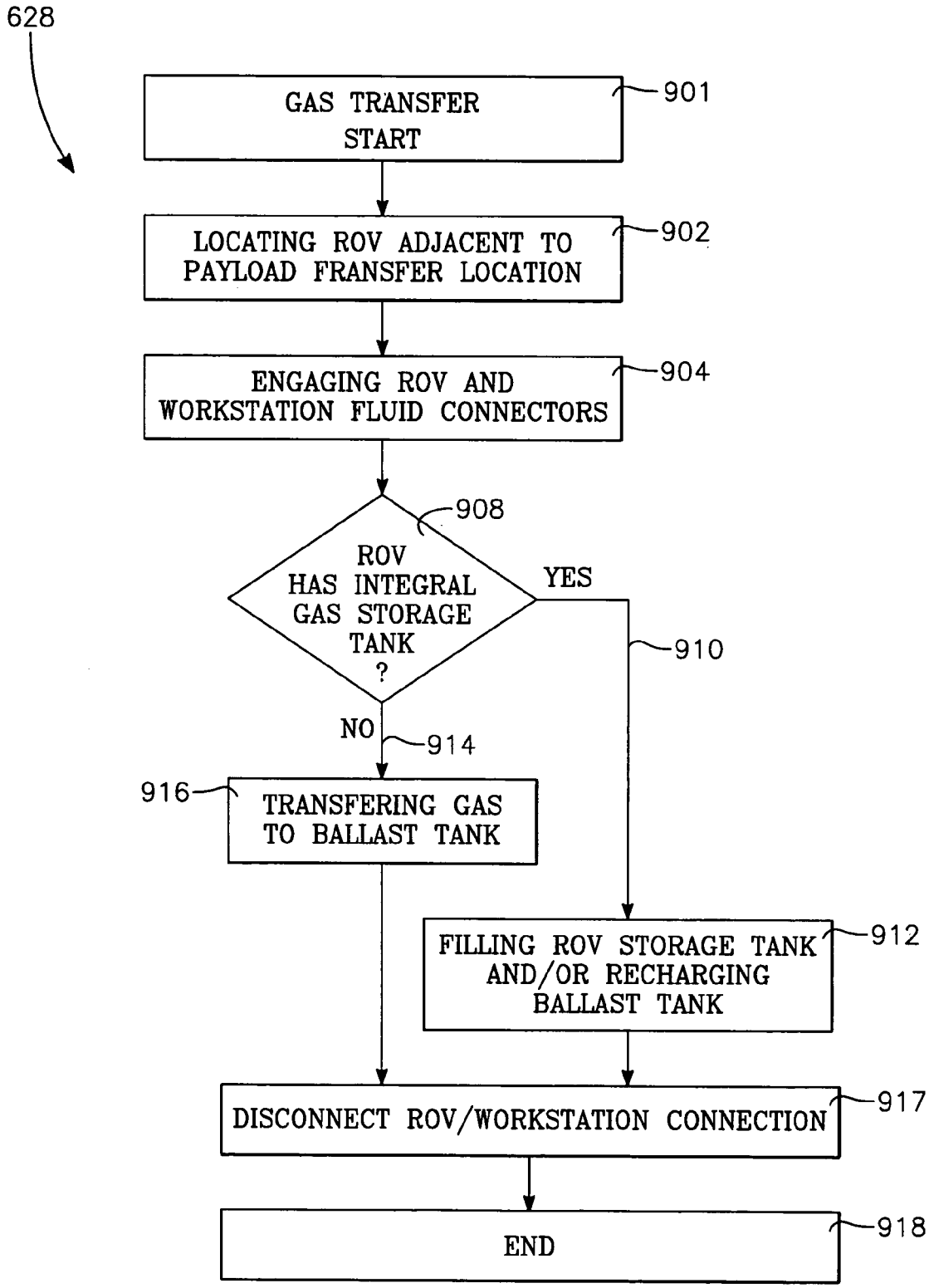
FIG. 9 is a flowchart showing steps that comprise the gas transfer activity.

Referring to FIG. 9, exemplary gas transfer activity is further illustrated by flowcharted steps. The methodology begins at step 901 and progresses to step 902 where the ROV is located adjacent to the payload transfer location 136. Step 904 follows where the ROV engages its connector(s) 318 with the workstation connector(s) 350 forming a ROV/workstation connection(s) 702; at least one of the ROV/workstation connection(s) is a fluid connector. Decision step 908 follows to check for the presence of a ROV gas storage tank 304. If a tank is present the methodology proceeds along flowchart branch 910 to step 912 where gas is selectively transferred to one or both of the ROV gas storage tank and the ballast tank 312. If a ROV gas storage tank is not present then the methodology proceeds along flowchart branch 914 to step 916 where gas is selectively transferred to the ballast tank. Steps 912 and 916 lead to Step 917 where the ROV/workstation connection(s) is disconnected. End-step 918 follows step 917.

Referring also to FIG. 3, the gas transfer activities of steps 912 and 916 require a source of gas external to the ROV. External gas supplies include a gas storage tank integral to the workstation 356, a gas storage tank separate from the workstation 372, or a combination of both.

Figure 10:
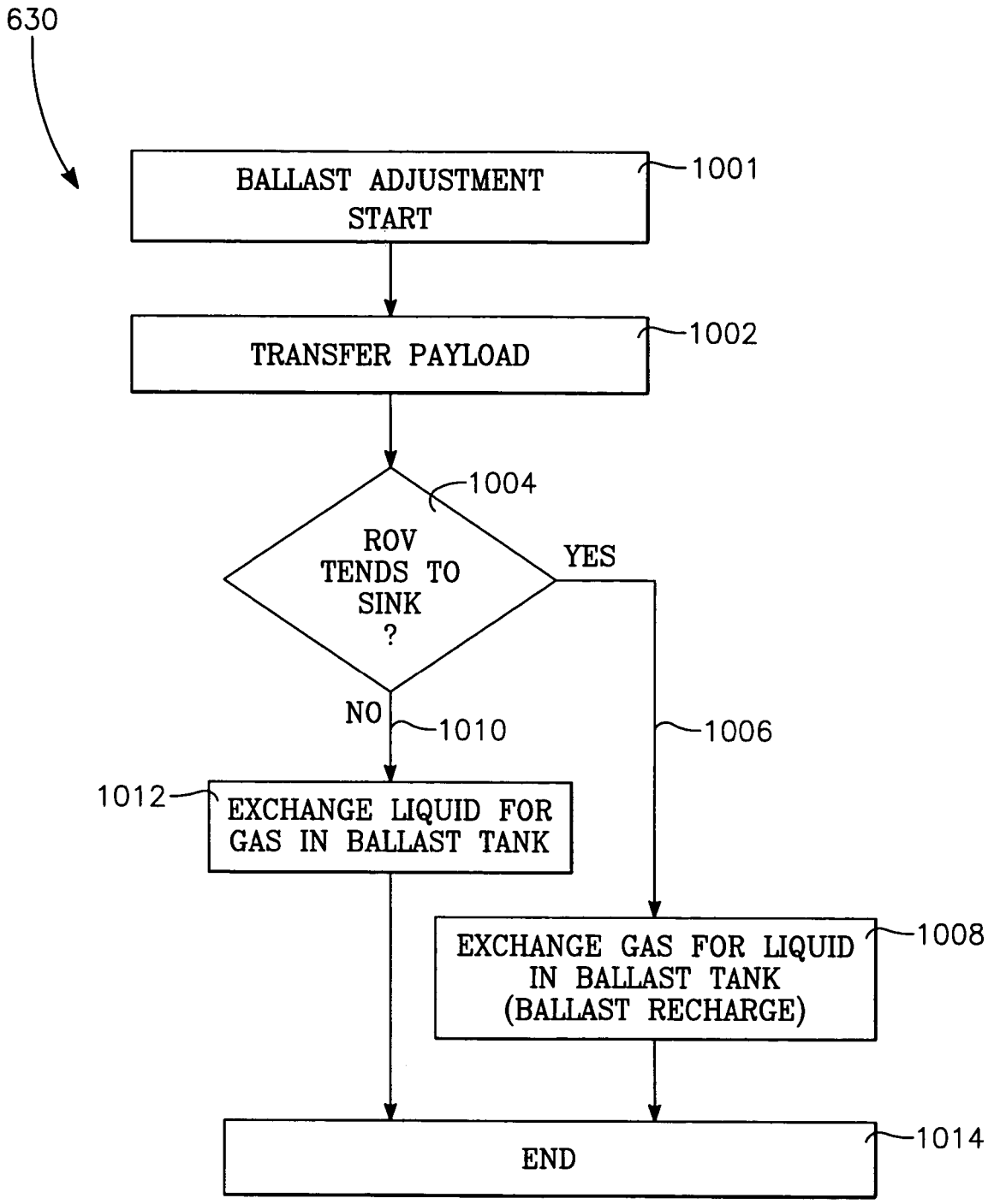
FIG. 10 is a flowchart showing steps that comprise the buoyancy adjustment activity.

During the workstation operation 614, the payload transfer activity 626 is typically associated with a buoyancy adjustment activity 630. Referring to FIG. 10, the buoyancy adjustment activity is illustrated by flowcharted steps. The methodology begins at step 1001 and progresses to step 1002 where the ROV either on-loads or off-loads a payload. A decision block 1004 follows. If the ROV tends to sink as a result of the payload transfer, then the methodology proceeds along flowchart branch 1006 to step 1008. In step 1008, gas is exchanged for liquid (deballasting) in the ballast tank to restore neutral buoyancy to the ROV. Conversely, if the ROV tends to rise after the payload transfer, then the methodology proceeds along flowchart branch 1010 to step 1012. In step 1012, liquid is exchanged for gas (ballasting) in the ballast tank to restore neutral buoyancy to the ROV. From either step 1008 or 1012 the methodology progresses to step 1014 where it ends leaving the ROV in a neutrally buoyant state.

Referring also to FIGS. 3 and 6, when the ROV 116 has an integral gas storage tank 304, the buoyancy adjustment activity 630 and the gas transfer activity 628 need not occur simultaneously; for that case the ROV may perform one or more gas recharge steps 1008 prior to carrying out a gas transfer. Conversely, if the ROV lacks an integral gas storage tank, the gas recharge step 912 does require a simultaneous gas transfer to the ROV. When the workstation operation 614 is completed, the transport operation 616 follows.

Referring to FIGS. 6 and 7, the transport operation 616 is further described by tabulated activities. In particular, the figure shows that the transport operation comprises the ROV moving with the payload 632 from a first location 136 to a second location 134. When the transport operation is completed, the destination operation 618, which includes off-loading, follows.

Referring to FIGS. 6, 7, and 8, the destination operation 618 is further described by tabulated activities. In particular, the figures show that the destination operation comprises activities including the payload transfer activity 626 and the buoyancy adjustment activity 630. The payload transfer activity, including on-loading and off-loading, has been described above in connection with FIG. 8. The buoyancy adjustment activity has also been described above in connection with FIG. 9. When the destination operation is completed a continuation decision 710 elects either a first cycle alternative 712 or a second cycle alternative 714.

Referring again to FIGS. 6 and 7, the first cycle alternative 712 is followed by the return operation 620 that continues the ROV work task 606. In particular, the figures show that the return operation comprises the ROV move without the payload 638 from the second payload transfer location 134 back to the first payload transfer location 718. When the return operation is completed the ROV is ready to begin another cycle of the work task.

Referring to FIGS. 6 and 7, the second cycle alternative 714 reflects the choice to discontinue the current ROV work task 606. The ROV 116 may be recovered 608 at this time. FIGS. 1 and 2 illustrate alternative operations for recovering the ROV 116 when the second cycle alternative is chosen. In FIG. 1, a first recovery alternative 622 involves the use of a ROV cage 112. The ROV is maneuvered from the second payload transfer location 134 into the cage at location 136 near the worksite. The cage is then recovered to the surface vessel 102. In FIG. 2, a second recovery alternative 624 does not involve use of a ROV cage. Here, the ROV is recovered directly from the second payload transfer location to the surface vessel 102. Those skilled in the art will recognize that in lieu of immediate recovery, the ROV might be employed on other similar tasks prior to being recovered to the surface.

What is claimed is:

1. A method for managing the buoyancy of a remotely operated vehicle (ROV) working at an underwater site comprising:

providing a ballast tank located within said ROV;

mounting a first connector on the ROV, said connector being in fluid communication with the ballast tank;

providing a first gas storage system separate from the ROV;

locating a second connector proximate to a worksite, said second connector being in fluid communication with the first gas storage system;

mating the first and second connectors; and, recharging the ballast tank by transferring gas from the first gas storage system to the ballast tank.

2. The method of claim 1, further comprising:

providing an underwater workstation proximate to the worksite and having said second connector attached to the workstation where the workstation and ROV are connected to one another by the mating of said first and said second connectors.

3. The method of claim 2, wherein the first gas storage system is mounted on the workstation.

4. The method of claim 3, further comprising:

providing a second gas storage system separate from said ROV and the workstation, said second gas storage system being in fluid communication with the second connector; and, transferring gas from the second gas storage system to the ballast tank for gas recharge.

5. The method of claim 3, further comprising:

providing a second gas storage system separate from the ROV and the workstation, said second gas storage system being in fluid communication with the first gas storage system; and, transferring gas from the second gas storage system to the first gas storage system for recharging the ballast tank.

6. A method for managing the buoyancy of a remotely operated vehicle (ROV) having a rigid hull working at an underwater site comprising:

providing a ballast tank and a first gas storage system located within the ROV;

mounting a first connector on the ROV, said connector being in fluid communication with the first gas storage system;

providing a second gas storage system separate from the ROV;

locating a second connector proximate to the worksite, said second connector being in fluid communication with the second gas storage system;

mating the first and second connectors;

transferring gas from the second gas storage system to the first gas storage system; and, recharging the ballast tank by transferring gas from the first gas storage system to the ballast tank.

7. The method of claim 6, further comprising:

providing an underwater workstation proximate to the worksite; and, mounting the second connector on the workstation.

8. The method of claim 7, wherein the second gas storage system is mounted on the workstation.

9. The method of claim 8, further comprising:

providing a third gas storage system separate from the ROV and the workstation, said third gas storage system being in fluid communication with the second connector; and, transferring gas from the third gas storage system to the first gas storage system for gas recharge.

10. The method of claim 8, further comprising:

providing a third gas storage system separate from the ROV and the workstation, the second gas storage system being in fluid communication with said third gas storage system; and, transferring gas from the third gas storage system to the second gas storage system for gas recharge.

11. A system located at a worksite for repetitively recharging a ballast tank located within a submerged remotely operated vehicle (ROV) having a rigid hull comprising:

a first fluid connector integral with the vehicle and a second fluid connector proximate to the worksite, said first and said second connectors being selectively engagable;

a fluid connection between the ballast tank and the first fluid connector; and, a gas storage means in fluid communication with said second connector for supplying gas to the ROV ballast tank when the first and second connectors are mated.

12. The system of claim 11 wherein a gas storage means integral with the ROV and in fluid communication with the first fluid connector and the ballast tank enables one or more gas recharge operations independent of the gas supply operations.

13. A method for positioning sacrificial anodes at an underwater site comprising:

providing a remotely operated vehicle (ROV), that comprises at least one claw for gripping, transporting and positioning a sacrificial anode at a desired location and an internal ballast tank which is capable of being recharged with air while underwater;

providing at least one sacrificial anode at an underwater worksite for positioning by said ROV;

mounting a first connector on the ROV, said connector being in fluid communication with the ballast tank;

providing a first air storage system separate from the ROV;

locating a second connector proximate to a worksite, said second connector being in fluid communication with the first air storage system;

mating the first and second connectors;

recharging the ballast tank by transferring air from the first air storage system to the ballast tank; and, using said ROV to grab said at least one sacrificial anode and transport to and position said sacrificial anode at a desired location.

* * * * *